US007802567B2

(12) United States Patent
Cadima et al.

(10) Patent No.: US 7,802,567 B2
(45) Date of Patent: Sep. 28, 2010

(54) DEVICE AND METHOD FOR A GAS BURNER

(75) Inventors: Paul Bryan Cadima, Prospect, KY (US); Shree Kumar, Karnataka (IN); Paul E. McCrorey, Mt. Washington, KY (US)

(73) Assignee: General Electric Company, Schenectady, NY (US)

( * ) Notice: Subject to any disclaimer, the term of this patent is extended or adjusted under 35 U.S.C. 154(b) by 308 days.

(21) Appl. No.: 11/960,582

(22) Filed: Dec. 19, 2007

(65) Prior Publication Data

US 2009/0159071 A1 Jun. 25, 2009

(51) Int. Cl.

| | |
|---|---|
| ***F24C 3/00*** | (2006.01) |
| ***F24C 3/12*** | (2006.01) |
| ***F23D 14/58*** | (2006.01) |
| ***F23D 14/62*** | (2006.01) |

(52) U.S. Cl. ..... 126/39 E; 126/41 R; 126/39 R; 431/349; 431/354

(58) Field of Classification Search ..... 126/39 E, 126/41 R; 431/349, 354; 239/419.5; *F23D 14/06*
See application file for complete search history.

(56) References Cited

U.S. PATENT DOCUMENTS

| | | | | |
|---|---|---|---|---|
| 5,464,004 | A * | 11/1995 | Maughan | 126/39 E |
| 5,800,159 | A | 9/1998 | Maughan et al. | |
| 5,899,681 | A * | 5/1999 | Maughan | 431/8 |
| 6,132,205 | A * | 10/2000 | Harneit | 431/354 |
| 6,135,764 | A * | 10/2000 | Kwiatek | 431/266 |
| 6,325,619 | B2 * | 12/2001 | Dane | 431/284 |
| 6,439,881 | B2 * | 8/2002 | Haynes et al. | 431/354 |
| 2004/0241604 | A1 * | 12/2004 | Cadima | 431/354 |
| 2006/0121402 | A1 * | 6/2006 | Bettinzoli | 431/354 |

FOREIGN PATENT DOCUMENTS

| | | | |
|---|---|---|---|
| JP | 11270811 A | * | 10/1999 |
| JP | 2005140435 | * | 6/2005 |

OTHER PUBLICATIONS

WO 2005/088207, Liebetanz, Michael, (Nov. 22, 2005).*

* cited by examiner

*Primary Examiner*—Kenneth B Rinehart
*Assistant Examiner*—Frances Kamps
(74) *Attorney, Agent, or Firm*—Global Patent Operation; Douglas D. Zhang

(57) ABSTRACT

A gas burner assembly connected to a source of gas. The gas burner assembly has a burner body. The burner body has a generally enclosed chamber with a central axis and is configured with a generally circular wall. Ports are formed at the top of the wall and are in flow communication to an area external the burner body for combustion of the gas. A venturi directs the flow of gas from the source of gas into the chamber through an opening where the opening is offset from the central axis of the chamber. The burner body further has a stability chamber.

17 Claims, 6 Drawing Sheets

DEVICE AND METHOD FOR A GAS BURNER

BACKGROUND OF THE INVENTION

This invention relates generally to a method and apparatus for gas burners, and, more particularly, a method and apparatus for reduced circumference gas surface burner used in a gas-cooking product.

Atmospheric gas burners are commonly used as surface units in household gas cooking appliances. A significant factor in the performance of gas burners is their ability to withstand airflow disturbances from the surroundings, such as room drafts, rapid movement of cabinet doors, and oven door manipulation. Manipulation of the oven door is particularly troublesome because rapid openings and closings of the oven door often produce respective under-pressure and over-pressure conditions under the cook top.

These under-pressure and over-pressure conditions cause related pressure variations in the gas entering the burner chamber. Gas refers to any gas or fuel air mixture. The pressure variations can translate into flow disturbances at the burner ports causing flame extinction.

Some commercially available gas burners employ dedicated expansion chambers to attempt to improve stability performance. These expansion chambers are intended to dampen flow disturbances before such disturbances reach a respective stability flame. This damping is typically attempted by utilizing a large area expansion between an expansion chamber inlet and an expansion chamber exit, typically expanding by a factor of about ten. Accordingly, the velocity of a flow disturbance entering a burner throat is intended to be reduced by a factor of about ten prior to reaching a respective stability flame, thereby reducing the likelihood of flame extinction. Large area expansion and disturbance damping are not typically present in conventional main burner ports, making conventional main burner ports susceptible to flame extinction, especially at low burner input rates. Simmer stability is generally improved as the area expansion ratio is increased. If an expansion chamber inlet is sized too small, however, the gas entering an expansion chamber may be insufficient to sustain a stable flame at the expansion chamber port.

FIG. 1 illustrates an exemplary freestanding gas range 100 in which the herein described methods and apparatus may be practiced. Range 100 includes an outer body or cabinet 112 that incorporates a generally rectangular cook top 114. An oven, not shown, is positioned below cook top 114 and has a front-opening access door 116. A range backsplash 118 extends upward of a rear edge 120 of cook top 114 and contains various control selectors (not shown) for selecting operative features of heating elements for cook top 114 and the oven. It is contemplated that the herein described methods and apparatus is applicable, not only to cook tops which form the upper portion of a range, such as range 100, but to other forms of cook tops as well, such as, but not limited to, built in cook tops that are mounted to a kitchen counter. Therefore, gas range 100 is provided by way of illustration rather than limitation, and accordingly there is no intention to limit application of the herein described methods and apparatus to any particular appliance or cook top, such as range 100 or cook top 114.

Cook top 114 includes four gas fueled burner assemblies 200 which are positioned in spaced apart pairs positioned adjacent each side of cook top 114. Each pair of burner assemblies 200 is surrounded by a recessed area 124 of cook top 114. Recessed areas 124 are positioned below an upper surface 126 of cook top 114 and serve to catch any spills from cooking utensils (not shown in FIG. 1) being used with cook top 114. Each burner assembly 200 extends upwardly through an opening in recessed areas 124, and a grate 128 is positioned over each burner 200. Each grate 128 includes a flat surface thereon for supporting cooking vessels and utensils over burner assemblies 200 for cooking of meal preparations placed therein.

While, cook top 114 includes two pairs of grates 128 positioned over two pairs of burner assemblies 200 it is contemplated that greater or fewer numbers of grates could be employed with a greater or fewer number of burners without departing from the scope of the herein described methods and apparatus. Further, the burner assembly may rest directly on the cook top or within recesses.

Gas burners are subjected to pressure fluctuations both above the cook top on which they are mounted, as well as below. These pressures fluctuations can extinguish the flames of a burner when it is turned down to a very low setting. It is well known in the art that the addition of a stability chamber can improve stability at low flame settings. However, this concept requires the venturi tube to be located substantially adjacent to the inlet of the stability chamber. In traditional practice, the venturi is located in the center of round burners to provide uniform distribution of gas. Thus, the minimum diameter of the chamber of a burner that has a centrally located venturi and adjacent stability chamber can be approximated by the equation: Diameter of chamber=Diameter of venturi+2× radial length of stability chamber. Because the stability chamber requires a finite volume and length to function properly, a designer is often left with a burner diameter larger than desired in order to fit these features. Larger diameter burners are often not desired when space constraints, part cost, or efficiency demands are considered.

FIG. 2 is a side view of a known burner base. The width 164 of the burner body 150 is determined by the internal features, shown in FIG. 3. The height 162 provides height for the burner to be proximate to a grating (not shown) which, supports cooking vessels. The grating may be removeably attached to the burner body 150. Burner ports 154 are at the top of a wall 168 of the burner body. The wall 168 is generally annular and is formed about a central axis. Typically located above the burner ports is a burner cap (not shown). The burner cap closes the burner body 150 to create an internal chamber 156 such that the ports 154 and the stability chamber are the only exit for the gas during operation. The gas enters the burner body 150 through a venturi 152 from a burner throat 160 and accumulates in the chamber 156 before exiting the ports 154.

FIG. 3 is a top view of a known burner base 150 that can be used in a burner assembly for a gas range. Traditionally, the venturi 152 is located along the central axis 166 of a ring of burner ports 154. Stability chamber 160 is located to one side of the chamber 156 and opposite the stability chamber 160 is igniter mount 158 for mounting an electrode (not shown). The minimum diameter of the ring of ports is restricted by the size of the stability chamber 160 and the size of the venturi 152, and this is because the venturi 152 is located in the center of the burner.

BRIEF DESCRIPTION OF THE INVENTION

In one aspect, a gas burner assembly connected to a source of gas. The gas burner assembly has a burner body. The burner body has a generally enclosed chamber with a central axis and is configured with a generally circular wall. Ports are formed at the top of the wall and are in flow communication to an area external the burner body for combustion of the gas. A venturi directs the flow of gas from the source of gas into the chamber through an opening where the opening is offset from the central axis of the chamber. The burner body further has a stability chamber.

In another aspect, a gas range is provided. The gas range has a cook top and a gas burner assembly positioned in the cook top. The burner assembly is connected to a source of gas. The gas burner assembly has a burner body. The burner body comprises a chamber. The chamber has a generally circular wall with a central axis. A venturi directs the flow of gas from the source of gas into the chamber through an opening where the opening is offset from the central axis of the chamber. The burner body also comprises a stability chamber. Ports are formed at the top of the wall and are in flow communication with an area external the burner body for combustion of the gas. A burner cap is positioned on the burner body.

DETAILED DESCRIPTION OF THE INVENTION

While the methods and apparatus are herein described in the context of a gas-fired cook top, as set forth more fully below, it is contemplated that the herein described method and apparatus may find utility in other applications, including, but not limited to, gas heater devices, gas ovens, gas kilns, gas-fired meat smoker devices, and gas barbecues. In addition, the principles and teachings set forth herein may find equal applicability to combustion burners for a variety of combustible fuels. The description herein below is therefore set forth only by way of illustration rather than limitation, and is not intended to limit the practice of the herein described methods and apparatus.

Typically, for a burner, flow distribution is governed by individual port areas. A larger port from a chamber exhibits higher relative flow rates than smaller ports from the same chamber. Thus, port sizing, a static attribute of a burner, primarily determines percentage of total flow exhibited by a port. A secondary consideration is the distance a particular port is from the venturi. These attributes define the distribution of flow rates across the burner ports.

Figure 1:
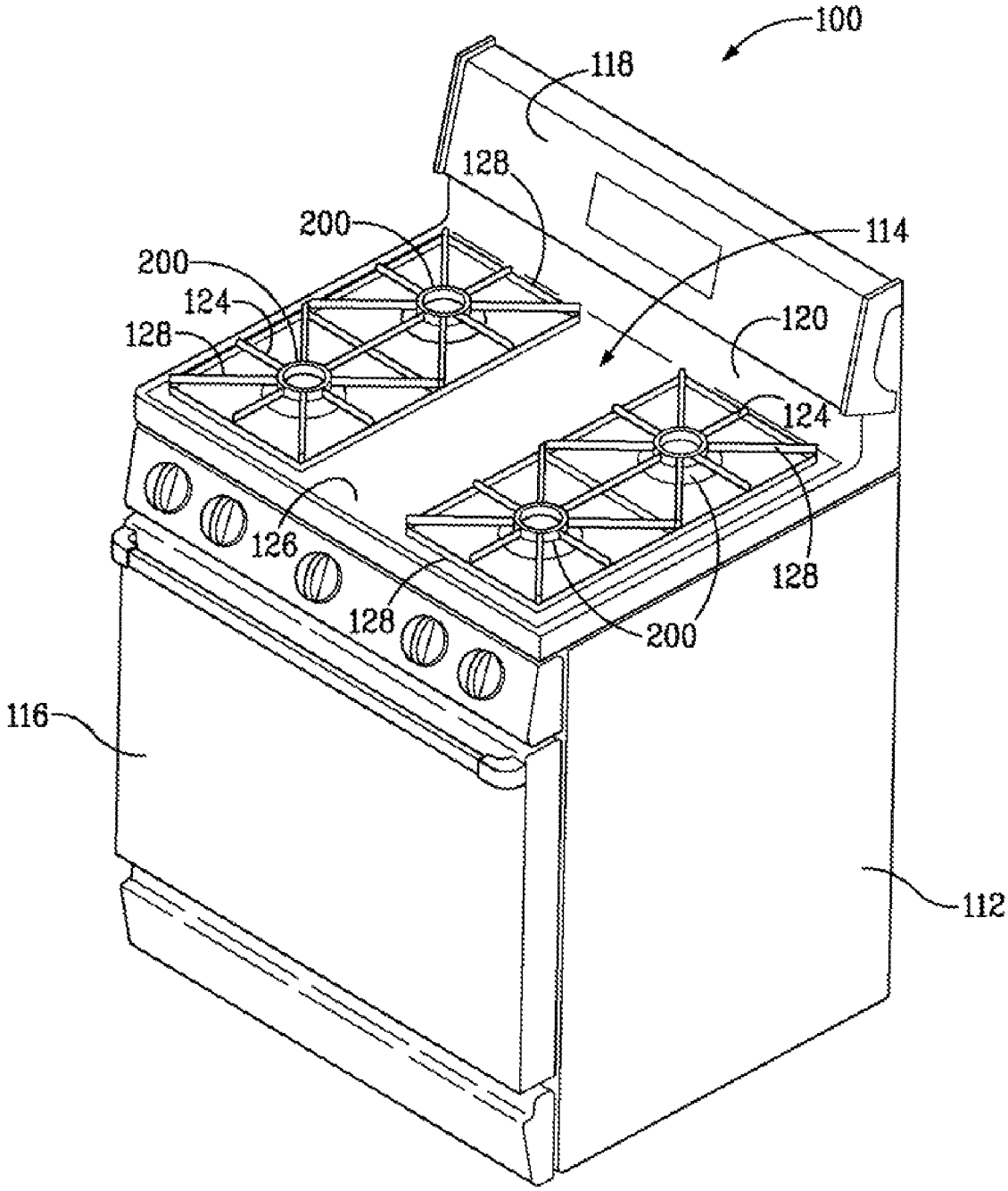
FIG. 1 is a perspective view of a gas range according to an embodiment of the invention.

FIG. 1 illustrates an exemplary freestanding gas range 100 in which the herein described methods and apparatus may be practiced. Range 100 includes an outer body or cabinet 112 that incorporates a generally rectangular cook top 114. An oven, not shown, is positioned below cook top 114 and has a front-opening access door 116. A range backsplash 118 extends upward of a rear edge 120 of cook top 114 and contains various control selectors (not shown) for selecting operative features of heating elements for cook top 114 and the oven. It is contemplated that the herein described methods and apparatus is applicable, not only to cook tops which form the upper portion of a range, such as range 100, but to other forms of cook tops as well, such as, but not limited to, built in cook tops that are mounted to a kitchen counter. Therefore, gas range 100 is provided by way of illustration rather than limitation, and accordingly there is no intention to limit application of the herein described methods and apparatus to any particular appliance or cook top, such as range 100 or cook top 114.

Cook top 114 includes four gas fueled burner assemblies 200 which are positioned in spaced apart pairs positioned adjacent each side of cook top 114. Each pair of burner assemblies 200 is surrounded by a recessed area 124 of cook top 114. Recessed areas 124 are positioned below an upper surface 126 of cook top 114 and serve to catch any spills from cooking utensils (not shown in FIG. 1) being used with cook top 114. Each burner assembly 200 extends upwardly through an opening in recessed areas 124, and a grate 128 is positioned over each burner 200. Each grate 128 includes a flat surface thereon for supporting cooking vessels and utensils over burner assemblies 200 for cooking of meal preparations placed therein.

While, cook top 114 includes two pairs of grates 128 positioned over two pairs of burner assemblies 200 it is contemplated that greater or fewer numbers of grates could be employed with a greater or fewer number of burners without departing from the scope of the herein described methods and apparatus. Further, the burner assembly may rest directly on the cook top or within recesses.

Gas burners are subjected to pressure fluctuations both above the cook top on which they are mounted, as well as below. These pressures fluctuations can extinguish the flames of a burner when it is turned down to a very low setting. It is well known in the art that the addition of a stability chamber can improve stability at low flame settings. However, this concept requires the venturi tube to be located substantially adjacent to the inlet of the stability chamber. In traditional practice, the venturi is located in the center of round burners to provide uniform distribution of gas. Thus, the minimum diameter of the chamber of a burner that has a centrally located venturi and adjacent stability chamber can be approximated by the equation: Diameter of chamber=Diameter of venturi+2× radial length of stability chamber. Because the stability chamber requires a finite volume and length to function properly, a designer is often left with a burner diameter larger than desired in order to fit these features. Larger diameter burners are often not desired when space constraints, part cost, or efficiency demands are considered.

Figure 2:
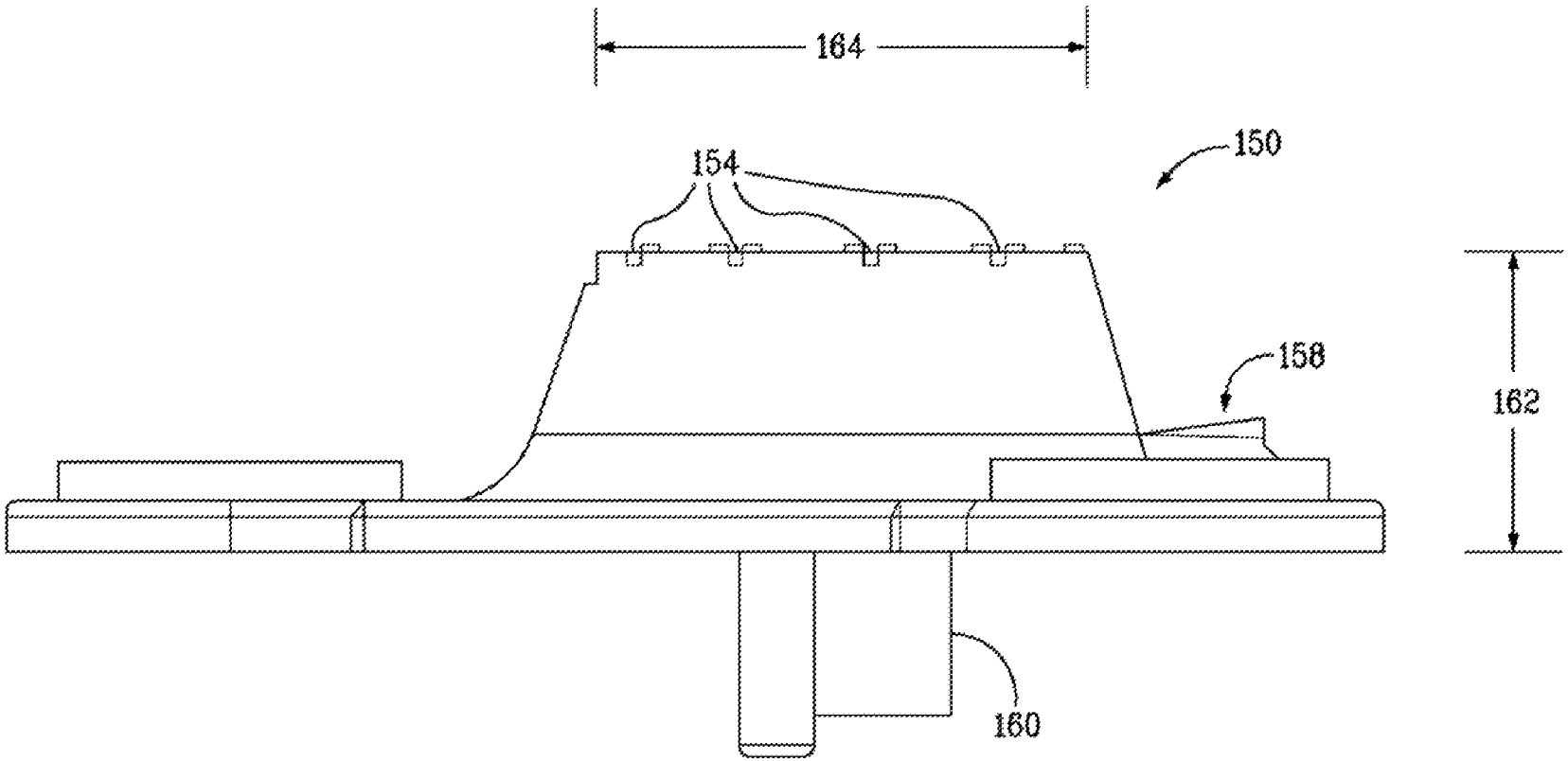
FIG. 2 Prior Art
FIG. 2 is a side view of a burner body for a cooking appliance known in the art.

FIG. 2 is a side view of a known burner base. The width 164 of the burner body 150 is determined by the internal features, shown in FIG. 3. The height 162 provides height for the burner to be proximate to a grating (not shown) which, supports cooking vessels. The grating may be removeably attached to the burner body 150. Burner ports 154 are at the top of a wall 168 of the burner body. The wall 168 is generally circular and is formed about a central axis. Above the burner ports is a burner cap (not shown). The burner cap closes the burner body 150 to create an internal chamber 156 such that the ports 154 and the stability chamber are the only exit for the gas during operation. The gas enters the burner body 150 through a venturi 152 from a burner throat 160 and accumulates in the chamber 156 before exiting the ports 154.

Figure 3:
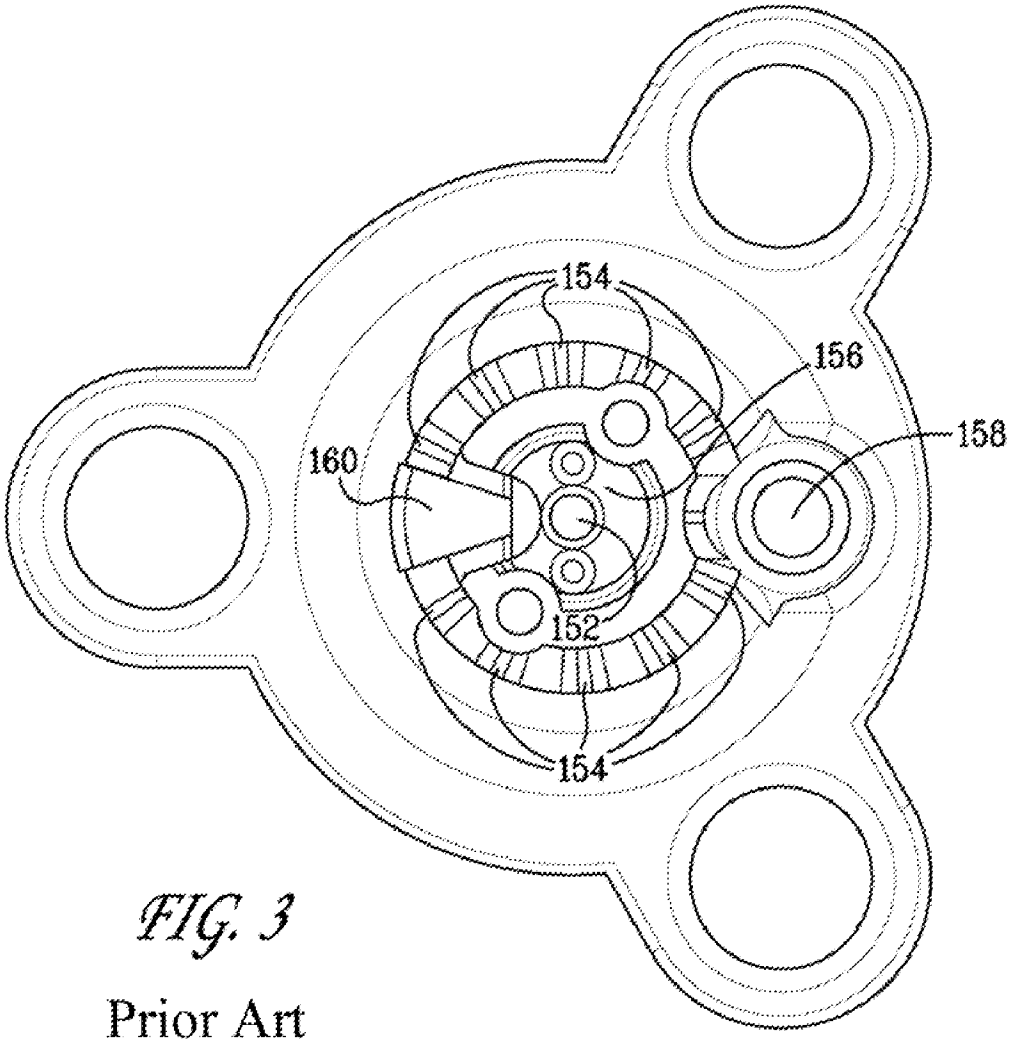
FIG. 3 Prior Art
FIG. 3 is a top view of a burner body for a cooking appliance known in the art.

FIG. 3 is a top view of a known burner base 150 that can be used in a burner assembly for a gas range. Traditionally, the venturi 152 is located at the central axis 166 of a ring of burner ports 154. Stability chamber 160 is located to one side and opposite the stability chamber 160 is igniter mount 158 for mounting an electrode (not shown). The minimum diameter of the ring of ports has been restricted by the size of the stability chamber 160 and the size of the venturi 152, since the venturi 152 was located in the center of the burner.

Figure 6:
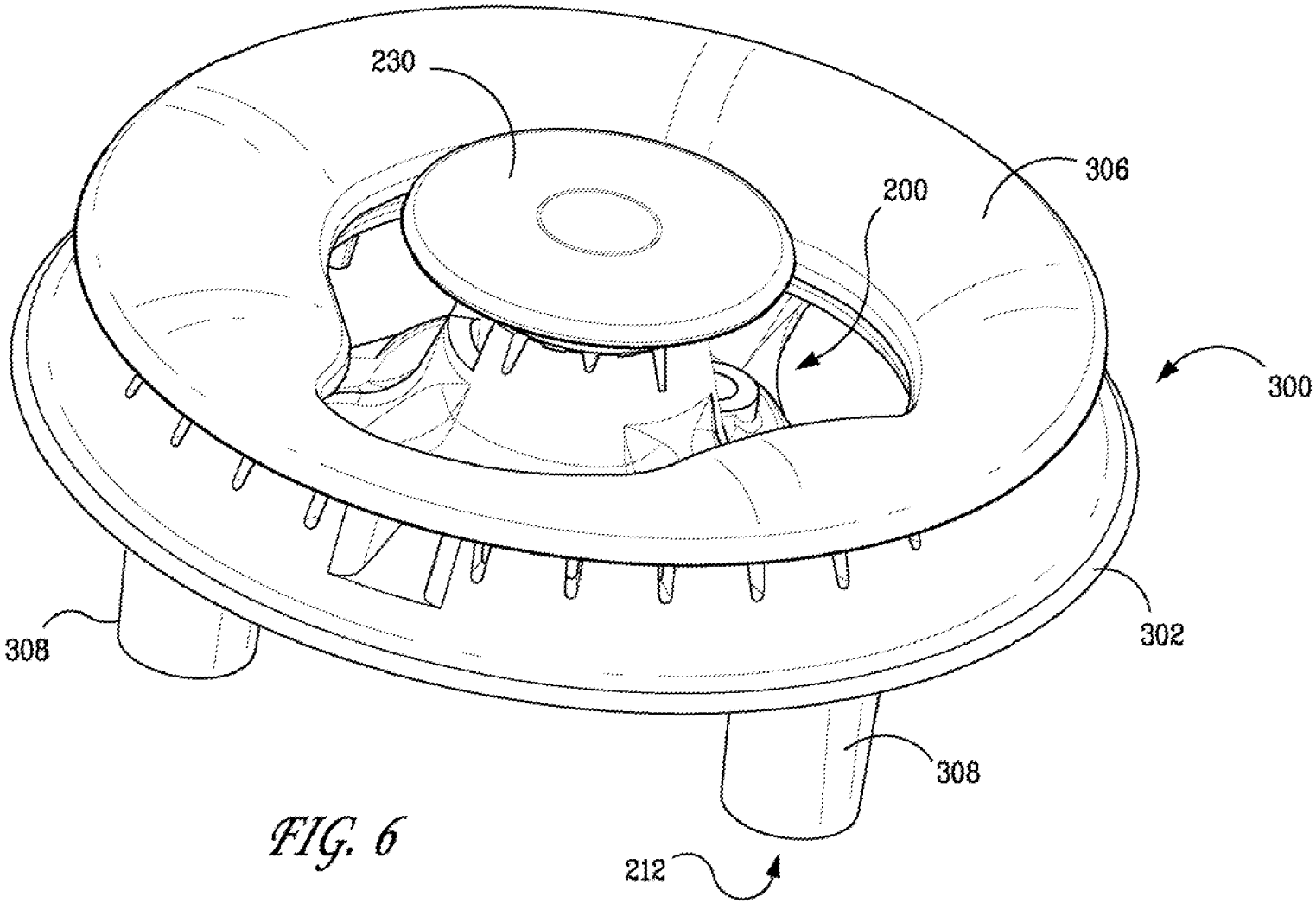
FIG. 6 is a perspective view of a multi-ring burner assembly incorporating a burner body according to an embodiment of the invention.

The trend in the burner industry has been to move towards burners having multiple port rings and multiple stages as shown in FIG. 6. Typically, a larger "doughnut" shaped outer burner 300 concentrically surrounds an inner smaller burner 200. This allows a wide range of heat outputs and allows more heat to be supplied to the center of the cooking vessel rather than heating the outer perimeter of the cookware. Consequently, if the inner burner 200 is large, the outer burner 300 must be increased in size to maintain a minimum spacing between the burners for sufficient airflow between the rings. This airflow is important to provide sufficient oxygen for the combustion of the gas. Thus, if the diameter of the inner burner is minimized, the outer burner may be made smaller. The reduction of burner size improves the residence time of the burning gas under the cooking vessel and improves efficiency by maximizing heat transfer to the cooking vessel.

Figure 4:
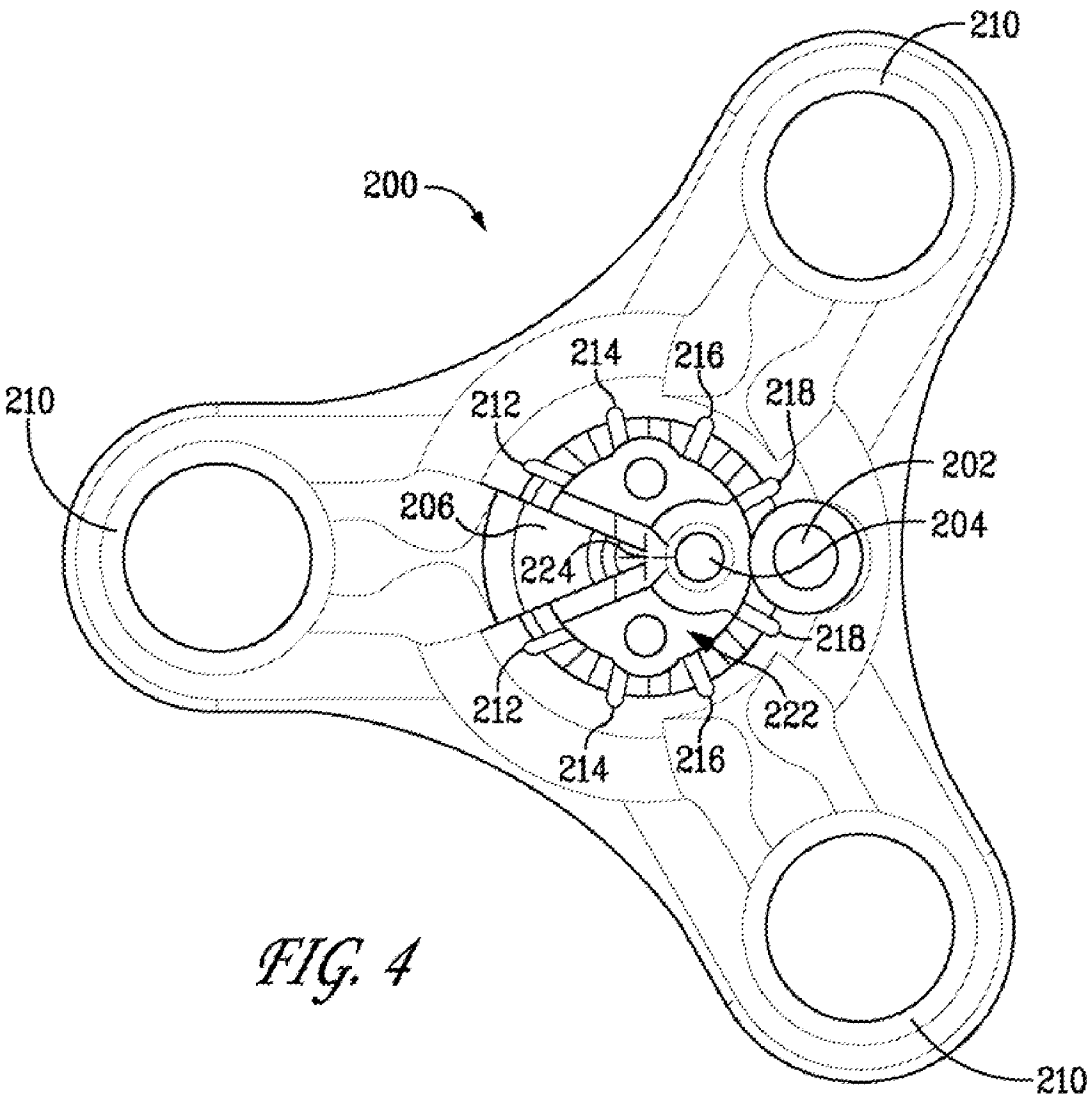
FIG. 4 is a top view of a burner body of a burner assembly of the range of FIG. 1 according to an embodiment of the invention.
Figure 5:
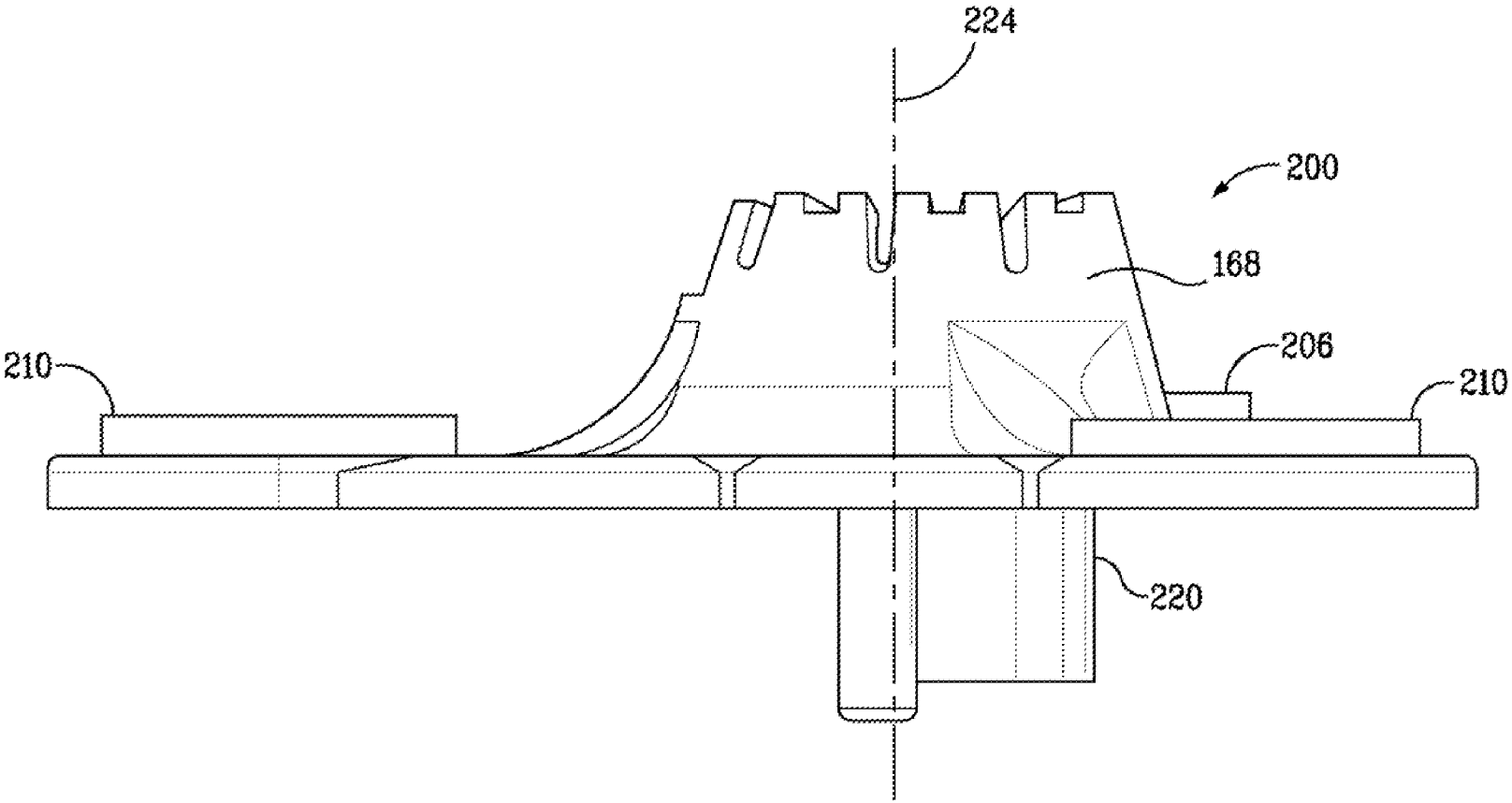
FIG. 5 is a side view of a burner body of a burner assembly of the range of FIG. 1 according to an embodiment of the invention.

Referring now to FIGS. 4, 5 and 6, where like reference numbers indicate same or similar features. FIG. 4 is a top view of a burner body 200 of a burner assembly of the range 100 of FIG. 1 according to an embodiment of the invention. In FIG. 4, the igniter mount is indicated by reference numeral 202. FIG. 5 is a side view of a burner body 200 of a burner assembly of the range 100 of FIG. 1.

The venturi 204 is offset from the axis 224 and as a result, unlike the prior art burners, the diameter of the burner body 200 is not directly determined by features internal to the burner body. As a result of this improvement, the stability chamber 206 remains a useful size without a portion of stability chamber 206 being outside the annular ring of ports. The height of the burner body 200 provides height for the burner to be proximate to cooking vessel. This can be particularly important as shown in FIG. 6 where a gas multi-ring burner assembly 300 is configured outside the gas burner assembly 200. Further, with a multi-ring burner assembly supports 210 provide a means for centering and properly locating the burner throats 308 of outer burner 300.

Burner ports 212, 214, 216, 218 are at the top of a wall 222 of the burner body 200. The wall 222 is generally annular and is formed about a central axis 224. Above the burner ports 212, 214, 216, 218 is a burner cap 230. The burner cap 230 (shown in FIG. 6) closes the burner body 200 so as to create an internal chamber 222 such that the ports 212, 214, 216, 218 are the only exit for the gas during operation. The gas enters the burner body 200 from a burner throat 220 and accumulates in the chamber 222 before exiting the ports 212, 214, 216, 218.

Because the venturi 204 is offset, from axis 224 each pair of ports 212, 214, 216, 218 are angled and shaped differently to optimize flow patterns based on the distance to the venturi. The longitudinal axis of ports 212, 214, 216, 218 are not specifically in radial alignment to either the center axis 224 or the center of the venturi 204. Each port is configured to promote flow and minimize obstruction. Ports 218, which are proximate to the venturi 204, can be subjected to substantial flow variations. To discourage the flow variations from affecting the burner flame ports 218 are taken out of linear alignment with venturi 204.

Referring to FIG. 6 a multi-ring burner assembly is shown. The multi-ring burner assembly has an inner burner assembly 200 and an outer burner assembly 300. Inner burner assembly has a single ring of ports and burner cap 230. Outer burner assembly 300 has 2 rings of ports. One ring of ports faces to the outside, the second ring of ports (hidden by cap 306) faces to the inside, or toward the inner burner assembly 200. Gas throats 308 provide a supply of gas to the outer burner body 302, and pass through supports 210 (see FIGS. 4 and 5) of the inner burner assembly 200.

The methods and apparatus described herein facilitate providing substantially higher heat outputs on gas surface burners, thereby improving an elapsed time to bring a food load to a desired temperature. By reducing the diameter of the burner heat transfer to smaller cooking vessels is improved affording improved efficiency and reduced energy requirements.

While the invention has been described in terms of various specific embodiments, those skilled in the art will recognize that the invention can be practiced with modification within the spirit and scope of the claims.

What is claimed is:

1. A gas range comprising:

a cook top; and a gas burner assembly positioned in the cook top and connectable to a source of gas, the gas burner assembly comprising:

a burner body comprising:

a generally circular wall defining a chamber having a central axis, the generally circular wall having a top surface and burner ports extending downward from the top surface;

a venturi for flowing gas from the source of gas into the chamber through an opening which is offset from the central axis; and a stability chamber proximate to the opening, the stability chamber having entry ports through which gas flows from the chamber into the stability chamber, a volume which increases in a direction from the entry ports toward the generally circular wall, and a length greater than a radius of the generally circular wall; and a burner cap positioned on the burner body.

2. The gas range of claim 1, wherein the source of gas is variable.

3. The gas range of claim 1, wherein the stability chamber is inside the chamber and does not extend radially beyond the generally circular wall.

4. The gas range of claim 1, further comprising an igniter mount positioned outside the generally circular wall and positioned approximately opposite the stability chamber.

5. The gas range of claim 1, further comprising a gas multi-ring burner assembly disposed concentrically outside the gas burner assembly.

6. The gas range of claim 1, wherein a longitudinal axis of each burner port is not aligned with the opening of the venturi.

7. The gas range of claim 1, wherein the longitudinal axis of each burner port is not aligned with the central axis.

8. The gas range of claim 1, wherein a longitudinal axis of each burner port is not aligned with the opening of the venturi or the central axis.

9. A gas burner assembly connectable to a source of gas, the gas burner assembly comprising:

a burner body comprising:

a generally circular wall defining a chamber having a central axis, the generally circular wall having a top surface and burner ports extending downward from the top surface;

a venturi for flowing gas from the source of gas into the chamber through an opening which is offset from the central axis; and a stability chamber proximate to the opening, the stability chamber having entry ports through which gas flows from the chamber into the stability chamber, a volume which increases in a direction from the entry ports toward the generally circular wall, and a length greater than a radius of the generally circular wall; and a burner cap positioned on the burner body.

10. The gas burner assembly of claim 9, wherein the source of gas is variable.

11. The gas burner assembly of claim 9, wherein the stability chamber is inside the chamber and does not extend radially beyond the generally circular wall.

12. The gas burner assembly of claim 9, further comprising an igniter mount positioned outside the generally circular wall and positioned approximately opposite the stability chamber.

13. The gas burner assembly of claim 9, further comprising a gas multi-ring burner assembly disposed concentrically outside the burner body.

14. The gas burner assembly of claim 9, configured in a cooking appliance.

15. The gas burner assembly of claim 9, wherein a longitudinal axis of each burner port is not aligned with the opening of the venturi.

16. The gas burner assembly of claim 15, wherein the longitudinal axis of each burner port is not aligned with the central axis.

17. The gas burner assembly of claim 9, wherein a longitudinal axis of each burner port is not aligned with the opening of the venturi or the central axis.

* * * * *